US006241552B1

(12) United States Patent
Pan

(10) Patent No.: US 6,241,552 B1
(45) Date of Patent: Jun. 5, 2001

(54) CONNECTING STRUCTURE TYPE (III) OF ELECTRICAL WIRES AND BULB UNITS OF A DECORATIVE LIGHTING NET

(76) Inventor: Wun Fang Pan, No. 123, Lane 99, Pu Din Road, Hsinchu (TW)

( * ) Notice: Subject to any disclaimer, the term of this patent is extended or adjusted under 35 U.S.C. 154(b) by 0 days.

(21) Appl. No.: 09/478,471

(22) Filed: Jan. 6, 2000

(51) Int. Cl.[7] ..... H01R 13/60
(52) U.S. Cl. ..... 439/575; 439/602
(58) Field of Search ..... 439/574, 575; 362/249, 226, 123, 391, 396

(56) References Cited

U.S. PATENT DOCUMENTS 4,903,177 * 2/1990 Warning ..... 362/123
5,154,508 * 10/1992 Ahroni ..... 362/226
5,193,255 * 3/1993 Tseng et al. ..... 24/625
5,380,208 * 1/1995 Ying ..... 439/558
5,428,516 * 6/1995 Harris ..... 362/226
5,584,567 * 12/1996 Rumpel ..... 439/575
5,607,230 * 3/1997 Protz, Jr. ..... 362/396
5,632,552 * 5/1997 Wang et al. ..... 362/396
5,839,819 * 11/1998 Pan ..... 362/252
6,048,077 * 4/2000 Pan ..... 439/575
6,082,874 * 7/2000 Huang ..... 439/575

* cited by examiner

*Primary Examiner*—Gary F. Paumen
*Assistant Examiner*—Phuongchi Nguyen
(74) *Attorney, Agent, or Firm*—Rosenberg, Klein & Lee

(57) ABSTRACT

A connecting structure type (III) of a decorative lighting net includes several electrical wires intercrossed and connected with a plurality of bulb units to become a complete net or a curtain-type decoration. A receiver having an inner circular groove is formed at a side of the bulb holder and an L-shape beam is formed at a side of the bulb connector. After assembly of the bulb holder, the wires, and the bulb connector, the receiver and the L-shape beam will fix the wires with the bulb unit securely and that obtains a perfect connection between the wire and the bulb unit.

1 Claim, 4 Drawing Sheets

CONNECTING STRUCTURE TYPE (III) OF ELECTRICAL WIRES AND BULB UNITS OF A DECORATIVE LIGHTING NET

BACKGROUND OF THE INVENTION

Conventional decorative lighting net, used popularly in this time, is comprised of several lighting strings with an electrical wire and a plurality of miniature bulb units, wherein the wires are intercrossed and connected with bulb holders. A connecting structure is provided to connect the electrical wire and the bulb unit together to become a net. The known connecting structure is simply an elastic hook mounted on the bulb holder to hook the wire. It can not provide enough connecting strength. The wire will be released from the hook of the bulb holder without difficulty when a sideward force occurs. So the net structure will be destroyed and the decorative effect is thus lost.

In view of the problem, it is a primary object of the invention to provide a connecting structure type (III) of a decorative lighting net, which includes a receiver having an inner circular groove formed on a side of a bulb holder and a L-shape beam formed on a bulb connector. By use of the receiver and the beam, the bulb unit gains a better connecting strength with the electrical wire and overcome the drawback of prior art.

Now the features and advantages of the invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
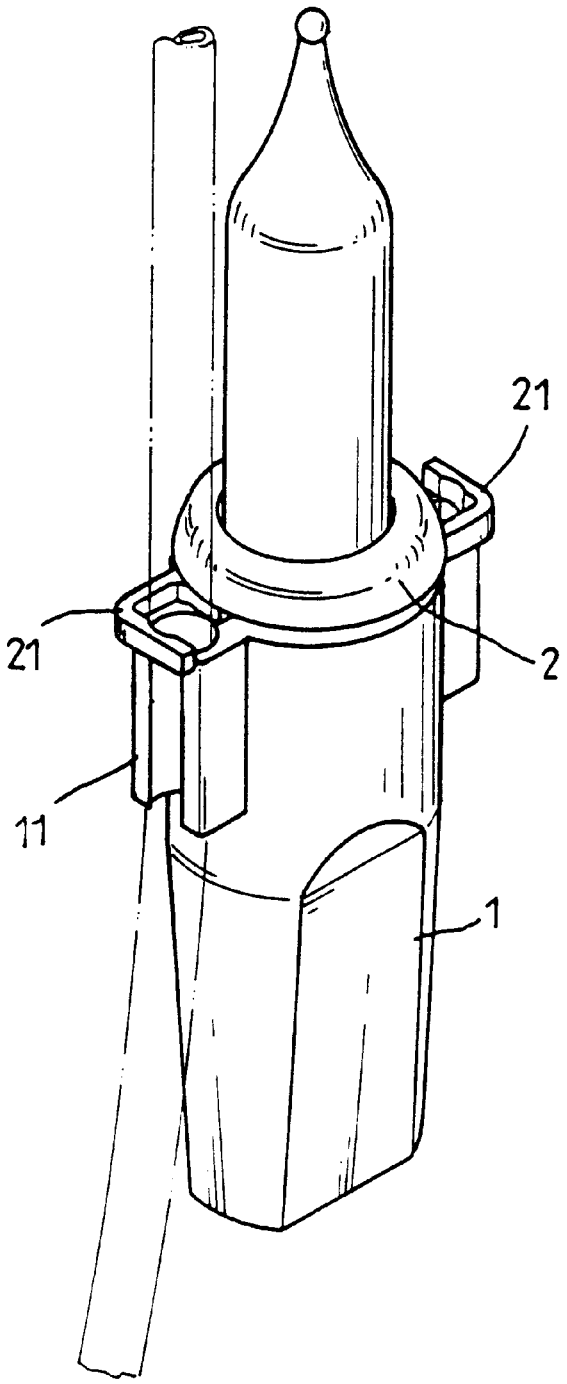
FIG. 1 is a perspective view illustrating the connecting structure of a bulb unit according to the invention.
Figure 2:
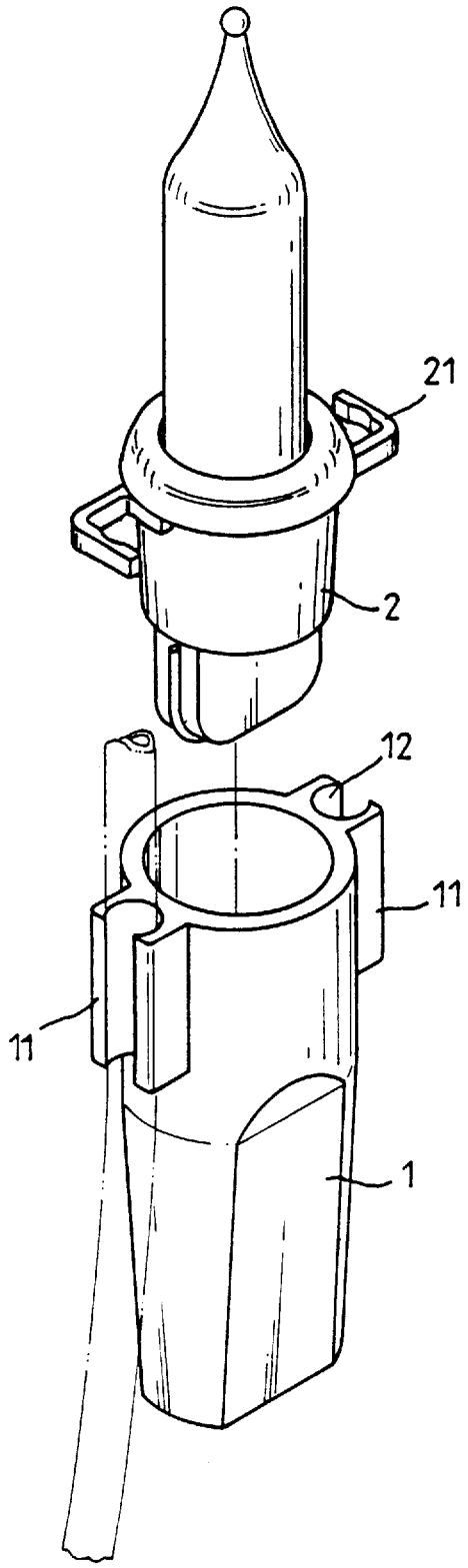
FIG. 2 is an exploded perspective view of FIG. 1.
Figure 3:
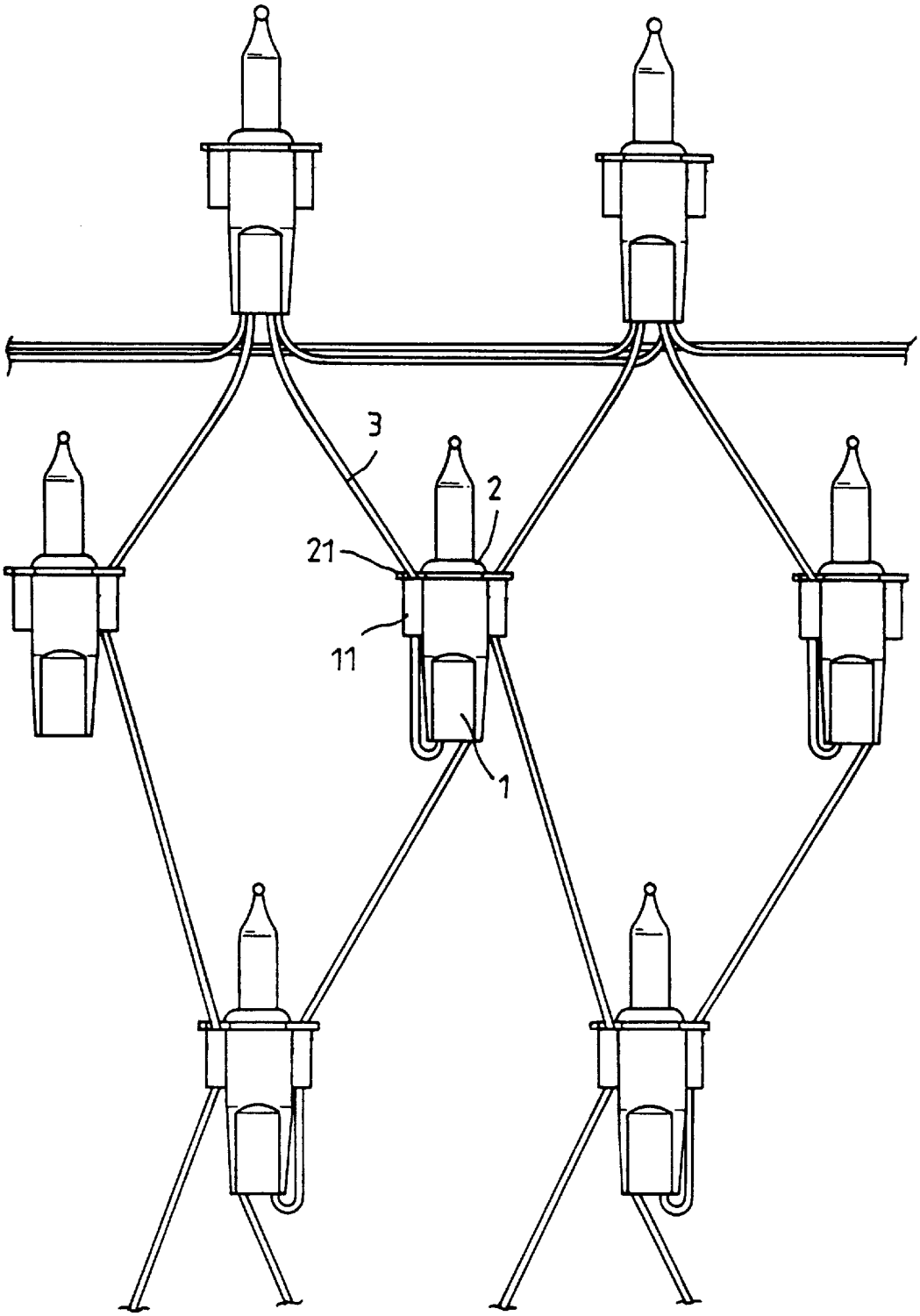
FIG. 3 is a plan view depicting a decorative lighting net according to the present invention.

Referring to FIGS. 1 to 3, the present invention is to provide an improvement on a connecting structure of a decorative lighting net. It can be seen that both sides of the bulb holder (1) are provided with a respective receiver (11) having an inner circular groove (12). Both sides of the bulb connector (2) are provided with a respective L-shape beam (21). When the connector (2) is received in the bulb holder (1), the L-shape beam (21) just seals an opening segment of the circular groove (12) of the receiver (11) of the bulb holder (1).

In use, the electrical wire (3) is received in the groove (12), and then the bulb connector (2) is put into the bulb holder (1). After this connection, the electrical wire (3) will be fixed by the beam (21) and can never be separated from the receiver (11). It can be understood that the connection of the electrical wires will be strong enough to connect the wires and the bulb units to become a decorative lighting net, as shown in FIG. 3, to show a perfect lighting effect.

Figure 4:
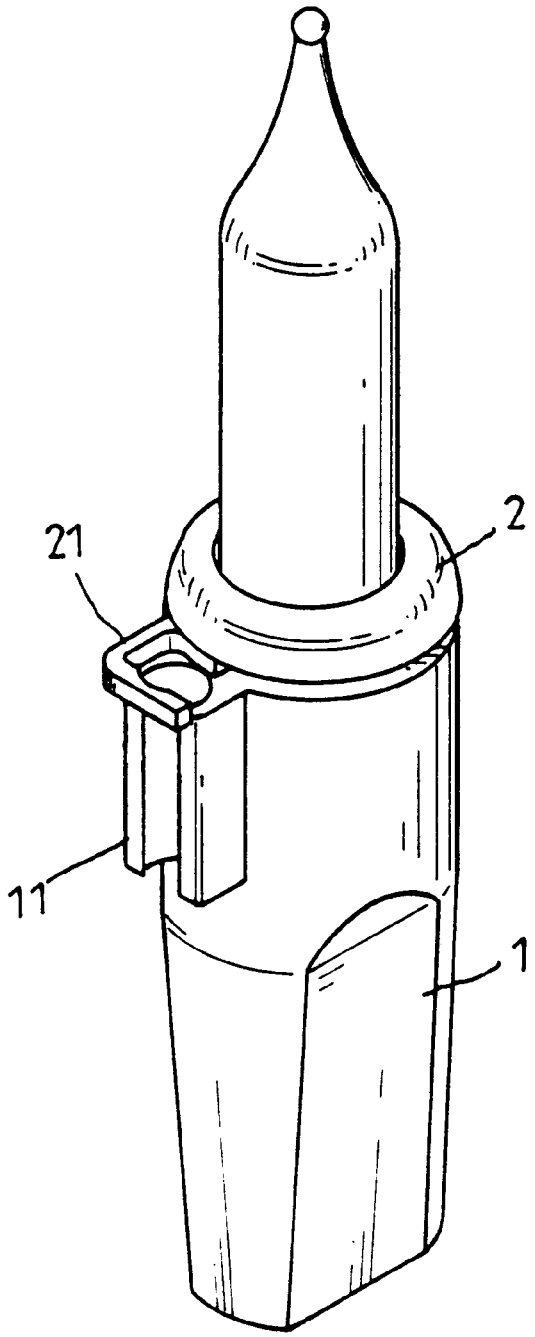
FIG. 4 is a perspective view illustrating another embodiment of the connecting structure of a bulb unit according to the invention.

In FIG. 4, it depicts only a connecting structure is provided for use as a curtain-type decorative lighting string. This embodiment can also obtain a same purpose for utility.

In summary, the present invention provides a decorative lighting net with an invented structure and providing a better connecting effect. It has superiority over prior art net structures obviously and should be allowed for patent.

What is claimed is:

1. A connecting structure of a decorative lighting net including several electrical wires intercrossed and connected with a plurality of bulb units, each of the plurality of bulb units comprising (a) a bulb holder provided with at least one longitudinally extended receiver on one side of the bulb holder and having a longitudinally extended inner circular groove and a longitudinal opening segment formed in the receiver in open communication with the inner circular groove for receiving a respective one of the wires in the inner circular groove through the opening segment, and (b) a bulb connector having at least one L-shaped beam extending in a direction transverse to the longitudinal direction at a location corresponding with the at least one receiver, the L-shaped beam being juxtaposed on a an upper end of the at least one receiver in overlaying correspondence with the opening segment of the circular groove of the receiver of the bulb holder for preventing the wire from being separated from the at least one receiver to maintain a complete decorative net or a curtain-type lighting string.

* * * * *